United States Patent [19]

Koga et al.

[11] Patent Number: 4,563,571

[45] Date of Patent: Jan. 7, 1986

[54] ELECTRIC WATER HEATING DEVICE WITH DECREASED MINERAL SCALE DEPOSITION

[75] Inventors: Ryoichi Koga; Yutaka Takahashi, both of Nara, Japan

[73] Assignee: Matsushita Electric Industrial Company, Limited, Osaka, Japan

[21] Appl. No.: 455,244

[22] Filed: Dec. 10, 1982

[30] Foreign Application Priority Data

| | | | |
|---|---|---|---|
| Dec. 16, 1981 | [JP] | Japan | 56-204331 |
| Dec. 16, 1981 | [JP] | Japan | 56-204332 |
| Dec. 16, 1981 | [JP] | Japan | 56-204333 |
| Apr. 13, 1982 | [JP] | Japan | 57-61588 |
| Apr. 15, 1982 | [JP] | Japan | 57-63725 |

[51] Int. Cl.[4] ..... H05B 3/82; F24H 1/20

[52] U.S. Cl. ..... 219/299; 219/305; 219/306; 219/368; 219/374; 219/381; 219/543

[58] Field of Search ..... 219/296–309, 219/310, 312, 316, 335, 336, 543, 368, 374, 380, 381

[56] References Cited

U.S. PATENT DOCUMENTS

| | | | |
|---|---|---|---|
| 1,188,952 | 6/1916 | Laird | 219/316 X |
| 1,519,395 | 12/1924 | Clench | 219/299 |
| 1,634,704 | 7/1927 | Brand | 219/296 X |
| 1,671,677 | 5/1928 | Keeton | 219/306 |
| 1,688,796 | 10/1928 | Baker | 219/305 X |
| 2,228,004 | 1/1941 | Ewing | 219/306 |
| 4,035,613 | 7/1977 | Sagawa et al. | 219/543 X |

FOREIGN PATENT DOCUMENTS

| | | | |
|---|---|---|---|
| 332688 | 4/1926 | Belgium . | |
| 1920602 | 12/1970 | Fed. Rep. of Germany . | |
| 89508 | 6/1921 | Switzerland . | |
| 190072 | 6/1937 | Switzerland | 219/303 |
| 2043 | of 1859 | United Kingdom | 219/306 |
| 1502479 | 3/1978 | United Kingdom . | |

*Primary Examiner*—A. Bartis

*Attorney, Agent, or Firm*—Lowe, King, Price & Becker

[57] ABSTRACT

An electric water heater includes an outer cylindrical structure having first and second openings defining a water inlet and outlet, respectively, and an inner cylindrical structure having an inner passage therethrough and coaxially disposed in the outer cylindrical structure to define an outer passage therebetween. The inner and outer passage are interconnected at one end of the structures and communicate respectively with the first and second openings. The inner cylindrical structure includes a cylindrical ceramic support secured at one end to the other end of the outer cylindrical structure, an electric resistance heating element on the outer surface of the ceramic support and a ceramic sheet having a thickness smaller than the ceramic support wound on the heating element so that it is embedded in the sheet. A helical structure is provided in the outer passage for generating turbulence therein so that thermal energy is transferred from the heating element to the outer surface of the inner cylindrical structure at a rate greater than the rate at which energy is transferred from the heating element to the inner surface of the inner cylindrical structure whereby the temperature at the inner and outer surfaces of the inner cylindrical structure are equalized when water is supplied at a predetermined flow rate and kept at a level lower than that at which mineral scale is likely to be deposited in the passages.

12 Claims, 7 Drawing Figures

ELECTRIC WATER HEATING DEVICE WITH DECREASED MINERAL SCALE DEPOSITION

BACKGROUND OF THE INVENTION

Conventional water heating devices comprise an outer cylindrical structure or casing, an inner cylindrical structure coaxially supported in the casing to define an outer water-flow passage between the two cylindrical structures, and an inner water-flow passage within the inner structure, the outer and inner flow passages being in communication with each other at one end of the casing. The inner structure comprises a cylindrical support formed of ceramic and secured at one end to one end of the casing, a resistance heating element on the outer surface of the cylindrical support and a ceramic sheet in which the heating element is embedded. The surface temperature of the inner structure, or heater is determined by the relative thicknesses of the ceramic support and sheet and the heat transfer coefficient to water on the inner and outer surfaces of the heater. Since the water flows in the inner flow passage at a speed higher than it flows in the outer flow passage, the heat transfer coefficient is greater at the inner wall of the heater than at its outer wall. As a result, the heater has a greater thermal resistance on the inner surface than on the outer surface due to the larger thickness of the cylindrical support. Therefore, the temperature at the inner wall of the heater is higher than the temperature at the outer surface and the difference between them is as large as 40° C. Such temperature differences result in unbalanced heat transfer conditions, so that the entire surface area of the heater is not effectively utilized to transfer thermal energy. Furthermore, the outer surface temperature tends to rise excessively so that the water is boiled at localized areas and the main substances of the scales formed on the outer surface, such as calcium bicarbonate and magnesium bicarbonate, are dissolved and precipitate on the outer surface of the heater. Such precipitation causes the surface temperature to increase abnormally to the extent that the resistance element is broken.

SUMMARY OF THE INVENTION

According to the present invention, the water heating device comprises an outer cylindrical structure having first and second openings. An inner cylindrical structure having an inner water-flow passage therethrough, is coaxially disposed in the outer cylindrical structure to define an outer water-flow passage between the inner wall of the outer structure and the outer wall of the inner structure. The inner and outer water-flow passages are interconnected at one end of the outer structure and further communicate respectively with the first and second openings. The inner cylindrical structure comprises a cylindrical support formed of ceramic and secured at one end to the other end of the outer cylindrical structure. A heating element is disposed on the outer surface of the ceramic cylindrical support, and a sheet of ceramic is wound on the heating element so that the heating element is embedded in the sheet. The ceramic sheet has a thickness smaller than the thickness of the cylindrical support. The resulting arrangement is such that the temperatures at the outer and inner surfaces of the inner cylindrical structure are equalized to each other with water being supplied through one of the first and second openings at a predetermined flow rate and lower than a level above which scale is, likely to develop in the passages.

Specifically, the thermal transfer coefficient of the inner cylindrical structure from the heating element to the outer surface thereof is greater than the thermal transfer coefficient of the inner cylindrical structure from the heating element to the inner surface thereof.

In one embodiment of the invention, the temperature equalization is achieved by means to generating turbulence in the outer water-flow passage.

BRIEF DESCRIPTION OF THE DRAWINGS

The present invention will be described in further detail with reference to the accompanying drawings, in which.

DETAILED DESCRIPTION

Figure 1:
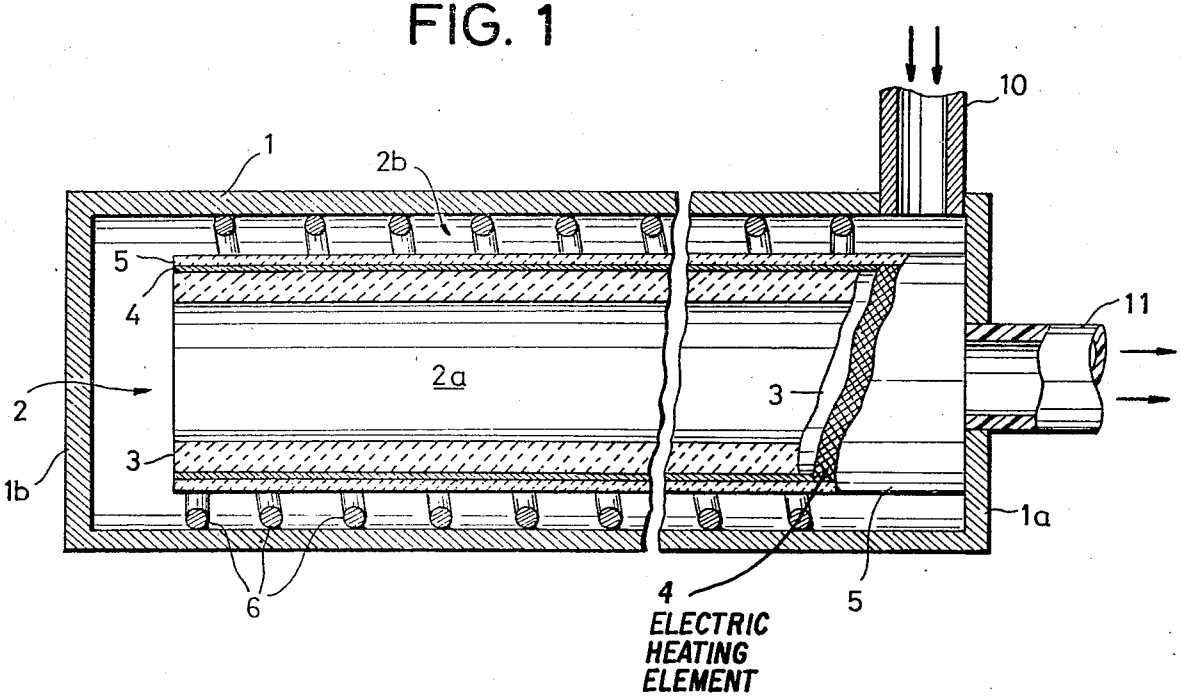
FIG. 1 is a cross-sectional view of a first embodiment of the water heating device of the invention.

Referring now to FIG. 1, there is shown a first embodiment of the water heating device of the present invention. The water heating device comprises a cylindrical casing 1 closed at opposite ends and a ceramic heater 2 of a cylindrical structure extending into the casing 1 through a first end wall 1*a* thereof. The inner end of the heater 2 is spaced from the second end wall 1*b* of the casing 1 and the outer end extends outwards from the first end wall 1*a* of the casing to define an outlet port 11. Water is admitted through an inlet port 10 into an outer channel 2*b* defined between the inner wall of casing 1 and the outer wall of heater 2 and flows in opposite direction through an inner channel 2*a* and is discharged through the outlet port 11. The heater 2 comprises a molded ceramic tubular support 3 coaxially mounted in spaced relationship with the casing 1. On the outer surface of the ceramic support 3 is wound a resistance heating element 4 to which current is supplied through leads, not shown. A ceramic sheet 5 is rolled on the heating element 4 and baked within an oven in a known manner. The ceramic sheet 5 has a much smaller thickness than ceramic support 3 to avoid cracks which might develop during the baking process.

Figure 2:
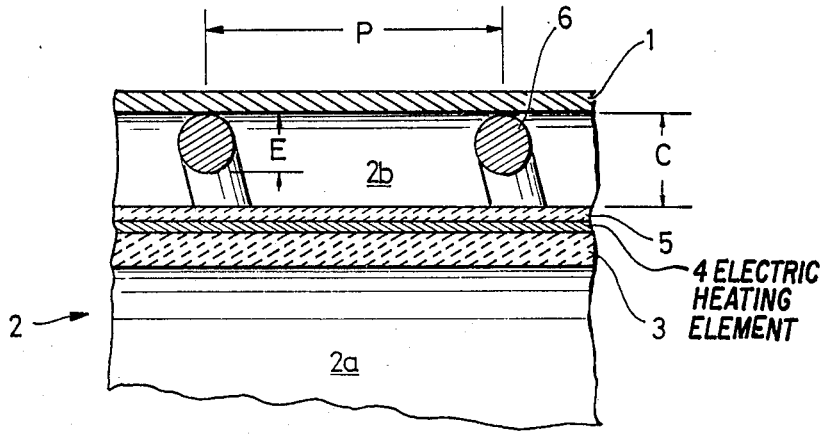
FIG. 2 is an enlarged view of a portion of the embodiment of FIG. 1.

In accordance with the invention, a helical coil 6 is provided in the casing in contact with the inner wall thereof to serve as a means for generating turbulence in the outer passage 2*b* as well as a means for causing the liquid to follow a helical path. As shown in FIG. 2, it is assumed that the helical coil 6 has a pitch P and a radial dimension E from its inner side to its outer side which is in contact with the inner wall of the casing 1, and the outer passage 2*b* has a width C which is equal to one-half the difference between the inner diameter of the casing 1 and the outer diameter of the heater 2. It is found that at a predetermined flow rate, an optimum value of the ratio $(E/C)_{opt}$ is in the range of 0.6 to 0.8, preferably 0.7. The optimum value of the ratio $(P/E)_{opt}$ is determined in relation with the optimum ratio $(E/C)_{opt}$ such that the product $(P/E)_{opt} \times (E/C)_{opt}$ is in a preferred range. It is found that the preferred range of the product is 2 to 6.

In a practical embodiment, the water heater with C=2.0 mm, E=1.4 mm, P=6.7 mm has achieved a thermal transfer coefficient of 10,600 Kcal/m$^2$ hr° C. which is 8.0% higher than the target value of thermal transfer coefficient. Since the helical coil or temperature reduction means 6 can be manufactured in a wide range of dimensions, a desired thermal transfer coefficient can be easily obtained for water heaters having different dimensions.

Figure 3:
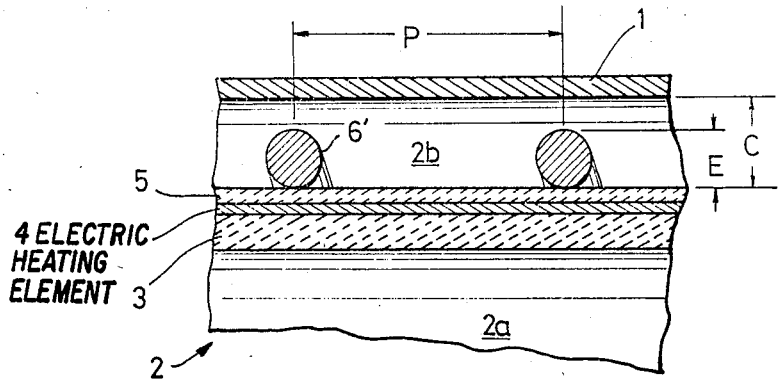
FIG. 3 is a cross-sectional view of a modified form of the FIG. 1 embodiment.

Alternatively, a helical coil structure 6' is mounted on and in contact with the heating element 2 as illustrated in FIG. 3. In this case, the optimum ratio $(E/C)_{opt}$ is found to be 0.4 to 0.6, preferably 0.5.

Figure 4:
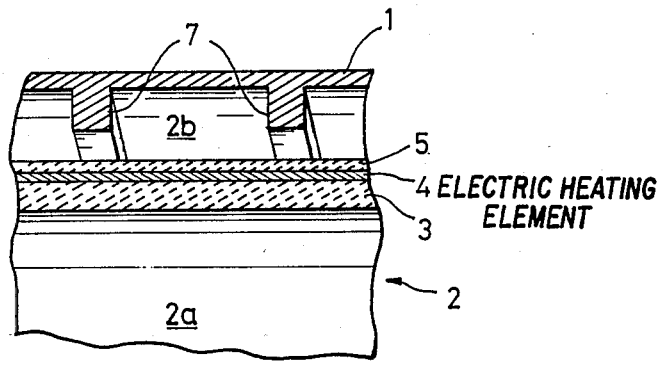
FIGS. 4 and 5 are cross-sectional views of further embodiments of the invention.
Figure 5:
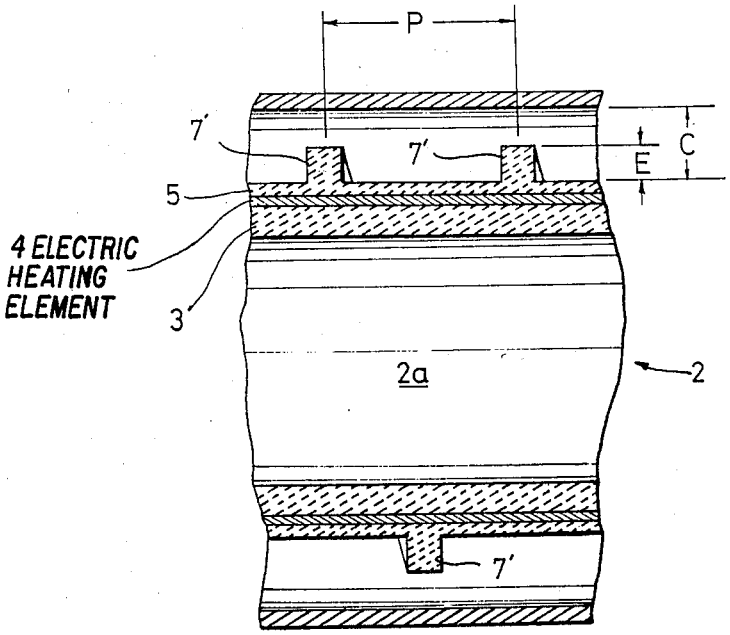

FIG. 4 is an illustration of a second embodiment of the invention in which the helical coil or temperature reduction structure is formed integrally with or cemented to the casing 1 as shown at 7. Preferably, the helical coil structure 7 may be provided on the inner surface of the casing 1 as shown at 7' in FIG. 5. Because the latter arrangements allow the helical coil structure 7' to be thermally coupled with the outer surface of the heating element 2, it serves as a heat radiator for reducing the surface temperature as well as a means for generating turbulence to make the outer surface temperature balance against the inner surface temperature, whereby the maximum surface temperature is effectively reduced to a level at which the scale is no longer dissolved into water.

Figure 6:
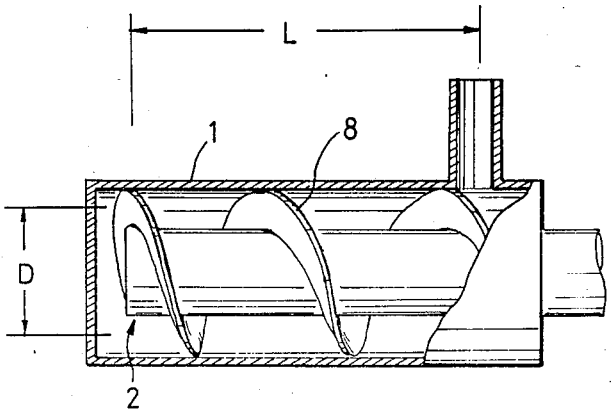
FIG. 6 is a cross-sectional view of a still further embodiment of the invention.

The helical coil or temperature reduction means may also be constructed of a helical fin as shown at 8 in FIG. 6 which extends radially over the width C of outer passage **2*b* and longitudinally over the length of the heating element 2 so that water follows a helical path which is given by $L/\sin\theta$ in the outer passage at a speed $(1/\sin\theta)$ times higher than in the inner passage 2*a*, where $\theta=\tan^{-1}(L/N)$(I for D), where L=length of heating element 2, N=number of turns of the helical structure 8, and D=average diameter over the length of the outer passage 2*b*. The turbulent liquid flow in the outer passage 2*b* promotes heat transfer from the outer surface of the heating element 2 to water. By appropriately proportioning the angle $\theta$, it is possible to increase the thermal transfer coefficient at the outer surface of heating element 2 to a desired value so that the outer and inner temperatures are balanced with each other. Since the water in the outer passage 2*b*** flows uniformly, localized boiling can be effectively suppressed.

In a further embodiment of the invention, the temperature reduction is achieved by forming the outer portion 5 of the heating element 2 with a substance having a lower thermal conductivity and forming the cylindrical support structure 3 with a substance having a higher thermal conductivity. Preferably, the outer portion 5 has a thermal conductivity which is one-fourth the thermal conductivity of the inner structure 3, and has an equal thermal expansion coefficient thereto. Specifically, the cylindrical structure 3 comprises a ceramic of the alumina group and the outer layer 5 comprises a ceramic of the steatite group. In this way, the thermal transmission path of the outer portion 5 is lengthened in relation to the inner portion 3 making the temperatures at the outer and inner sides precisely equal.

Figure 7:
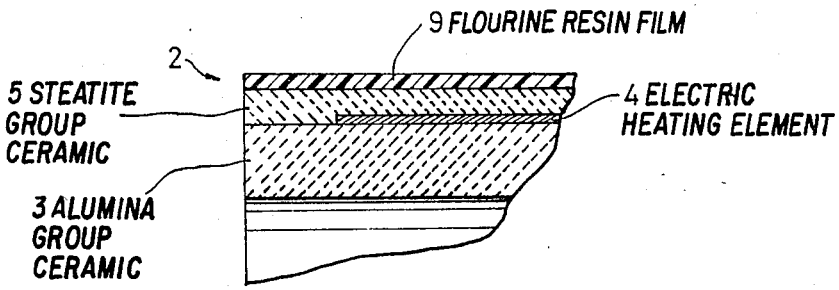
FIG. 7 is a cross-sectional view of another embodiment of the invention.

FIG. 7 is an illustration of a further embodiment of the invention in which the ceramic sheet 5 is coated with a thin film 9 having a thermal conductivity lower than the thermal conductivity of the inner portion 3 so that the temperatures on the outer and inner surfaces become equal to each other. As suitable material for the thin film 9 is fluorine resin, since the latter impedes the growth of scale thereon due to its nonsticking surface properties.

What is claimed is:

1. A water heating device comprising:

an outer tubular cylindrical structure having first and second openings;

an inner tubular cylindrical structure having an inner water-flow passage therethrough, said inner structure being coaxially disposed in said outer cylindrical structure to define an outer water-flow passage between an inner wall of said outer structure and an outer wall of said inner structure, said inner and outer water-flow passages being interconnected at one end of said outer structure and further communicated respectively with said first and second openings, the inner tubular cylindrical structure comprising a tubular cylindrical support formed of ceramic and secured at one end with the other end of said outer cylindrical structure, a heating element on the outer surface of the ceramic cylindrical support, and a sheet of ceramic wound on said heating element so that the heating element is embedded in said sheet, said sheet of ceramic having a thickness smaller than the thickness of said cylindrical support; and means for generating turbulence in said outer water-flow passage so that (1) thermal energy is transferred from said heating element to the outer surface of said inner cylindrical structure at a rate greater than a rate at which thermal energy is transferred from said heating element to the inner surface of said inner cylindrical structure, and (2) when water is supplied through one of said first and second openings at a predetermined flow rate the temperatures at the outer and inner surfaces of said inner cylindrical structure are substantially equal to each other and lower than a level at which scales are likely to develop in said passages, wherein said turbulence generating means includes a helical structure having a ratio of E/C=0.6 to 0.8, where E is the radial dimension of said helical structure and C is one-half the difference between the inner diameter of said outer cylindrical structure and the outer diameter of said inner cylindrical structure, and meets a relation (P/E) (E/C)=2 to 6, where P is the pitch of said helical structure.

2. A water heating device as claimed in claim 1, wherein said helical structure is integrally formed with said outer cylindrical structure.

3. A water heating device as claimed in claim 1, wherein said ceramic sheet has a thermal conductivity lower than the thermal conductivity of said ceramic support.

4. A water heating device as claimed in claim 3, wherein said ceramic sheet is formed of a material different from the material of said ceramic support.

5. A water heating device as claimed in claim 3, wherein a layer is cemented to said ceramic sheet, said layer having a thermal conductivity lower than the thermal conductivity of said ceramic support.

6. A water heating device as claimed in claim 5, wherein said layer is formed of fluorine resin.

7. The device of claim 1, wherein said helical structure is in contact with the inner wall of said outer cylindrical structure and spaced from the outer wall of said inner cylindrical structure.

8. A water heating device comprising:

an outer tubular cylindrical structure having first and second openings;

an inner tubular cylindrical structure having an inner water-flow passage therethrough, said inner structure being coaxially disposed in said outer cylindrical structure to define an outer water-flow passage between an inner wall of said outer structure and an outer wall of said inner structure, said inner and outer water-flow passages being interconnected at one end of said outer structure and further communicated respectively with said first and second openings, the inner tubular cylindrical structure comprising a tubular cylindrical support formed of ceramic and secured at one end with the other end of said outer cylindrical structure, a heating element on the outer surface of the ceramic cylindrical support, and a sheet of ceramic wound on said heating element so that the heating element is embedded in said sheet, said sheet of ceramic having a thickness smaller than the thickness of said cylindrical support; and means for generating turbulence in said outer water-flow passage so that (1) thermal energy is transferred from said heating element to the outer surface of said inner cylindrical structure at a rate greater than a rate at which thermal energy is transferred from said heating element to the inner surface of said inner cylindrical structure, and (2) when water is supplied through one of said first and second openings at a predetermined flow rate the termperatures at the outer and inner surfaces of said inner cylindrical structure are substantially equal to each other and lower than a level at which scales are likely to develop in said passages, wherein said turbulence generating means includes a helical structure having a ratio of $E/C=0.4$ to 0.6, where E is the radial dimension of said helical structure and C is one-half the difference between the inner diameter of said outer cylindrical structure and the outer diameter of said inner cylindrical structure, and meets a relation $(P/E)(E/C)=2$ to 6, where P is the pitch of said helical structure.

9. A water heating device as claimed in claim 8, wherein said helical structure is integrally formed with said ceramic sheet.

10. The device of claim 8, wherein said helical structure is in contact with the outer wall of said inner cylindrical structure and spaced from the inner wall of said outer cylindrical structure.

11. A water heating device as claimed in claim 12, wherein said helical structure extends from the outer wall of said inner cylindrical structure to the inner wall of said outer cylindrical structure.

12. A water heating device comprising:

an outer tubular cylindrical structure having first and second openings;

an inner tubular cylindrical structure having an inner water-flow passage therethrough, said inner structure being coaxially disposed in said outer cylindrical structure to define an outer water-flow passage between an inner wall of said outer structure and an outer wall of said inner structure, said inner and outer water-flow passages being interconnected at one end of said outer structure and further communicated respectively with said first and second openings, the inner tubular cylindrical structure comprising a tubular cylindrical support formed of ceramic and secured at one end with the other end of said outer cyulindrical structure, a heatilng element on the outer surface of the ceramic cylindrical support, and a sheet of ceramic wound on said heating element so that the heating element is embedded in said sheet, said sheet of ceramic having a thickness smaller than the thickness of said cylindrical support; and means for generating turbulence in said outer water-flow passage so that (1) thermal energy is transferred from said heating element to the outer surface of said inner cylindrical structure at a rate greater than a rate at which thermal energy is transferred from said heating element to the inner surface of said inner cylindrical structure, and (2) when water is supplied through one of said first and second openings at a predetermined flow rate the temperatures at the outer and inner surfaces of said inner cylindrical structure are substantially equal to each other and lower than a level at which scales are likely to develop in said passages, wherein said turbulence generating means includes a helical structure arranged so that water flowing through the outer passage follows a helical path defined by $L/\sin\theta$ in the outer passage at a speed $(1/\sin\theta)$ times higher than in the inner passage, where $\theta=\tan^{-1}(L/N)(1/D)$, where L=length of said heating element, N=number of turns of said helical structure and D=average diameter of the outer passage.

* * * * *